US010808448B2

(12) United States Patent
Yu

(10) Patent No.: US 10,808,448 B2
(45) Date of Patent: Oct. 20, 2020

(54) SAFE DOOR WITH RECESSED LOCK AND DOOR HANDLE

(71) Applicant: Fengyu Yu, Shanghai (CN)

(72) Inventor: Fengyu Yu, Shanghai (CN)

( * ) Notice: Subject to any disclaimer, the term of this patent is extended or adjusted under 35 U.S.C. 154(b) by 98 days.

(21) Appl. No.: 16/003,863

(22) Filed: Jun. 8, 2018

(65) Prior Publication Data

US 2019/0211609 A1 Jul. 11, 2019

(30) Foreign Application Priority Data

Jan. 8, 2018 (CN) ..... 2018 2 0028012 U

(51) Int. Cl.

| | |
|---|---|
| ***E05B 5/00*** | (2006.01) |
| ***E05G 1/026*** | (2006.01) |
| ***E05B 1/00*** | (2006.01) |
| ***E05G 1/04*** | (2006.01) |
| ***E05B 65/00*** | (2006.01) |
| ***E05B 53/00*** | (2006.01) |

(52) U.S. Cl.

CPC ..... *E05G 1/026* (2013.01); *E05B 1/0007* (2013.01); *E05B 5/00* (2013.01); *E05B 53/003* (2013.01); *E05B 65/0075* (2013.01); *E05G 1/04* (2013.01)

(58) Field of Classification Search

CPC ..... E05B 1/0007; E05B 5/00; E05B 53/003; E05B 65/0075; E05G 1/026; E05G 1/04

USPC ..... 70/101, 208, 224; 292/348–356; 109/45, 109/58.5, 59 R

See application file for complete search history.

(56) References Cited

U.S. PATENT DOCUMENTS

| | | | | |
|---|---|---|---|---|
| 2,459,920 A * | 1/1949 | Clark | E05B 13/101 70/223 |
| 2,592,095 A * | 4/1952 | Winn | E05B 3/04 292/351 |
| 3,827,820 A * | 8/1974 | Hoffman | B25H 3/003 403/165 |
| 4,679,420 A * | 7/1987 | Yang | E05B 17/0058 292/348 |
| 6,679,087 B2 * | 1/2004 | Suggs | E05B 65/0075 109/59 R |
| 8,904,837 B1 * | 12/2014 | Lin | E05B 47/026 109/59 R |
| 9,410,355 B2 * | 8/2016 | Suggs | E05G 1/04 |
| 2012/0291503 A1 * | 11/2012 | Yang | E05B 5/00 70/284 |

FOREIGN PATENT DOCUMENTS

GB 594737 A * 11/1947 ..... F25D 23/063

* cited by examiner

*Primary Examiner* — Suzanne L Barrett
(74) *Attorney, Agent, or Firm* — Bay State IP, LLC

(57) ABSTRACT

The utility model relates to a safe door with a recessed lock and door handle, which comprises a door plate, a door handle and a lock. The door handle is recessed and installed in a first step hole of the door plate through a first connecting structure, the lock is recessed and installed in a second step hole of the door plate, and the upper surfaces of the door handle and the lock are not higher than the upper surface of the door plate. The utility model redesigns the door plate, and sets the position where a lock disc and the door handle are installed into the form of step holes, so that the lock and the door handle are recessed and installed on the door plate.

9 Claims, 3 Drawing Sheets

SAFE DOOR WITH RECESSED LOCK AND DOOR HANDLE

CROSS REFERENCE TO RELATED APPLICATION

This application takes priority from and claims the benefit of Chinese Patent Application No. 201829928012.9 filed on Jan. 8, 2018, the contents of which are herein incorporated by reference.

TECHNICAL FIELD

The utility model belongs to the technical field of safe doors, and in particular relates to a safe door with a recessed lock and door handle.

BACKGROUND

With the improvement of material and cultural living standards of people and the development of the market economy, there are more and more kinds of valuables such as stocks, bonds, cashes, collectibles, etc., and with the rapid development of computer technology, various types of computer data recording media such as magnetic discs and optical discs need to be properly preserved. As a safety protection device, a safe is a preferred device that people use to store and prevent valuables from being stolen.

In order to prevent the valuables stored in a safe from being stolen, it is particularly important to enhance the anti-theft function of a safe. In the prior art, the structure of the safe lock is generally redesigned, or the structures of the safe door plate and the door frame are redesigned to achieve the purpose of anti-theft. However, the lock and the door handle of the prior art generally protrude from the surface of the door plate, which affects the aesthetic appearance of the safe itself on the one hand, and provides a criminal with more origins of force on the other hand, and which is conducive to prying the safe door so that the anti-theft function of the safe door is greatly weakened.

Therefore, a technical problem to be urgently solved by those skilled in the art is to provide a safe door with a recessed lock and door handle.

SUMMARY

In order to solve the above problems existing in the prior art, the utility model provides a safe door with a recessed lock and door handle. Through the redesign of the door plate structure, the lock and the door handle are recessed and installed on the door plate, so that an origin of force of a protruding structure is lost when the safe door is pried; at the same time, the door handle is designed with a pluggable structure, further eliminating the origin of force when the safe door is pried, and achieving the purpose of being prying-resistant.

The utility model is specifically implemented by the following technical solution.

According to a preferred embodiment, the utility model provides a safe door with a recessed lock and door handle, comprising a door plate, a door handle and a lock, wherein the door handle is recessed and installed in a first step hole of the door plate through a first connecting structure, the lock is recessed and installed in a second step hole of the door plate, and the upper surfaces of the door handle and the lock are not higher than the upper surface of the door plate.

According to a preferred embodiment, the first step hole comprises a first counterbore and a first positioning through-hole, and the door handle comprises a dial handle and a transmission shaft. The transmission shaft is snap-fit with the dial handle, and the transmission shaft is fixed within the first positioning through-hole through the first connecting structure and allows the dial handle to be located within the first counterbore.

According to a preferred embodiment, a straight prism shaft structure and a neck are provided on the dial handle, a straight prism blind hole matched with the straight prism shaft structure and a steel ball connecting mechanism are provided on the transmission shaft, and the dial handle and the transmission shaft are snapped in such a way that the straight prism shaft structure is matched with the straight prism blind hole and the neck is matched with the steel ball connecting mechanism.

According to a preferred embodiment, the steel ball connecting mechanism comprises at least a steel ball, a spring, a bolt, and a limiting hole, wherein the steel ball is connected to one end of the limiting hole near the inner wall of the straight prism blind hole of the transmission shaft, the bolt is connected to the other end of the limiting hole, and the steel ball and the bolt are connected by the spring.

According to a preferred embodiment, one end of the limiting hole connected to the steel ball is provided with a spherical port matched with the sphere of the steel ball, and the other end thereof is provided with a threaded structure matched with the bolt.

According to a preferred embodiment, the structure of the neck and the structure of the steel ball provided on the dial handle are matched.

According to a preferred embodiment, the transmission shaft is further provided with a positioning shaft and a first screw, wherein the transmission shaft positions the dial handle within the first counterbore in such a way that the positioning shaft is snap-fit with the first positioning through-hole and the first screw is connected with the first connecting structure.

According to a preferred embodiment, the first connecting structure comprises a gear, a first nut, a first gasket, a second gasket and a third gasket, and the first screw is sequentially connected with the first gasket, the second gasket, the gear, the third gasket and the first nut in series after being assembled in the first step hole, and is connected with a transmission mechanism of the lock through the gear in the first connecting structure.

According to a preferred embodiment, the second step hole comprises a second counterbore and a second positioning through-hole, the lock comprises a lock disc with a second screw and a second nut matched with the second screw, and the second screw is fixed in the second positioning through-hole through the second nut and allows the lock dial to be located within the second counterbore.

According to a preferred embodiment, the lock further comprises an inner lock and a data line, wherein the inner lock is fixed inside the door plate through a second connecting structure and is connected with the lock dial through the data line.

The safe door with a recessed lock and door handle provided by the utility model has at least the following advantages.

1. The utility model redesigns the structure of the door plate, and sets the position where a lock disc and the door handle are installed into the form of step holes, so that the lock and the door handle are recessed and installed on the door plate. The highest points of the door handle and the lock installed in this way are not higher than from the surface of the door plate. On the one hand, a criminal has reduced operating space in the process of prying a door, and cannot pry a door with the structure protruding from the surface of the door plate as an origin of force, which greatly enhances the prying-resistant function of the safe door; on the other hand, the aesthetic appearance of the door plate is increased, and the possible damage which may be caused by the impact on the lock and door handle during transportation and daily use is eliminated.

2. The utility model re-designs the structure of the door handle. The utility model has is simple in structure and high in reliability, and realizes the pluggable function of the door handle. When the door handle is subjected to the force of prizing, a dial handle will be detached, thereby further eliminating the possibility of using a dial handle as the origin of force in the process of prizing, which will further increase the difficulty of prizing, achieve the purpose of being prying-resistant, and improve the safety performance of a safe door.

BRIEF DESCRIPTION OF THE DRAWINGS

In order to more clearly explain the embodiments of the utility model or the technical solutions in the prior art, the drawings to be used in the description of the embodiments or the prior art will be briefly described below. Obviously, the drawings in the following description are only some embodiments of the utility model. Those skilled in the art may also obtain other drawings based on these drawings without any creative work.

Figure 1:
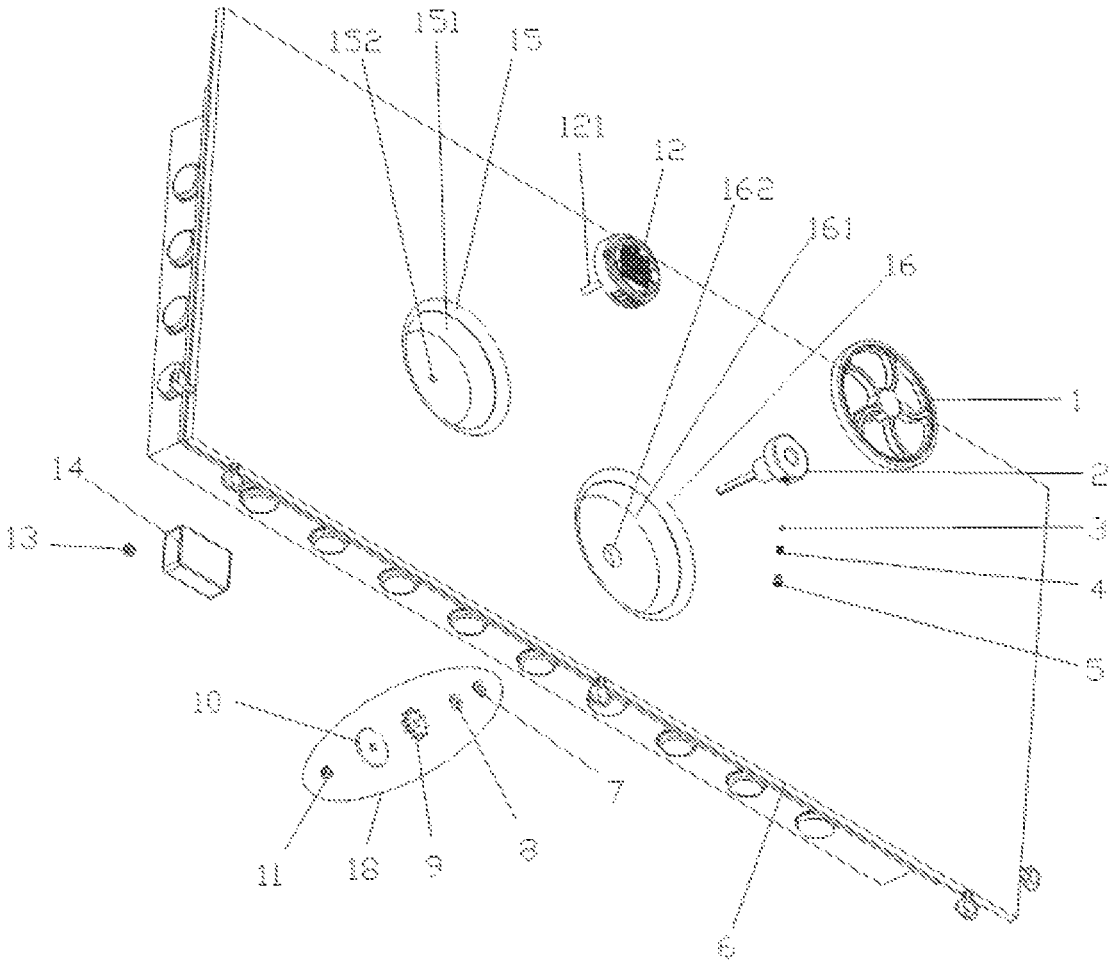
FIG. 1 is an exploded view of a lock and door handle recessed type safe door according to the utility model.

In the drawing, 1—a dial handle; 101—a neck; 102—a straight prism shaft structure; 2—a transmission shaft; 201—a straight prism blind hole; 202—a positioning shaft; 203—a first screw; 204—a limiting hole; 3—a steel ball; 4—a spring; 5—a bolt; 6—a door plate; 7—a first gasket; 8—a second gasket; 9—a gear; 10—a third gasket; 11—a first nut; 12—a lock disc; 121—a second screw; 13—a second nut; 14—an inner lock; 141—a second connecting structure; 15—a second step hole; 16—a first step hole; 17—a steel ball connecting mechanism; 18—a first connecting structure; 19—a door handle; 20—a lock; 21—a data line.

DESCRIPTION OF THE EMBODIMENTS

To make the objectives, technical solutions, and advantages of the utility model clearer, the technical solutions of the utility model will be described in detail below. Obviously, the described embodiments are only a part of the embodiments of the utility model, rather than all of the embodiments. All other embodiments obtained by those skilled in the art based on the embodiments of the utility model without any creative work shall fall within the protection scope of the utility model.

The upper surface of the door plate 6 described in the utility model refers to the surface of the exterior of the door plate 6 perpendicular to the ground when the safe is normally placed, that is, the plane of the door plate 6 wherein the door handle 19 and the lock disc 12 are installed; the upper surface of the door handle 19 refers to the plane where the dial handle 1 included in the door handle 19 is parallel to the upper surface of the door plate 6; and the upper surface of the lock 20 refers to the plane where the lock disc 12 is parallel to the upper surface of the door plate 6.

Referring to FIG. 1, the utility model provides a safe door with a recessed lock and door handle. The safe door comprises a door plate 6, a door handle 19 and a lock 20, wherein the door handle 19 is recessed and installed in a first step hole 16 of the door plate 6 through a first connecting structure 18, the lock 20 is recessed and installed in a second step hole 15 of the door plate 6, and the upper surfaces of the door handle 19 and the lock 20 are not higher than the upper surface of the door plate 6. On the one hand, a criminal has reduced operating space in the process of prying a door, and cannot pry a door with the structure protruding from the surface of the door plate 6 as an origin of force, which greatly enhances the prying-resistant function of the safe door; on the other hand, the aesthetic appearance of the door plate 6 is increased, and the possible damage which may be caused by the impact on the lock 20 and door handle 19 during transportation and daily use is eliminated.

Figure 2:
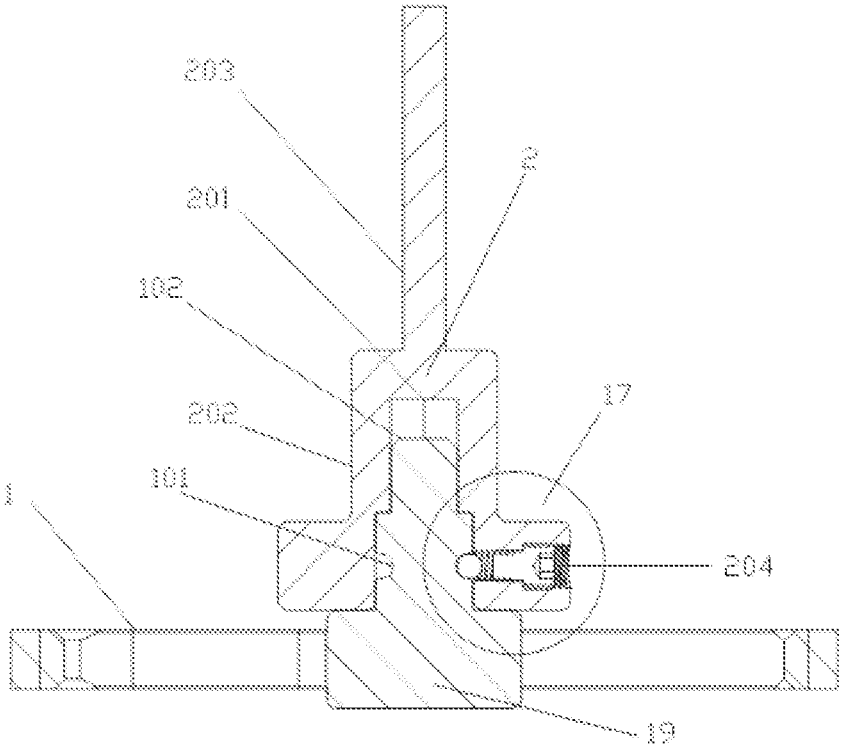
FIG. 2 is a sectional view of a door handle according to the utility model.

Referring again to FIGS. 1 and 2, the first step hole 16 comprises a first counterbore 161 and a first positioning through-hole 162. The door handle 19 comprises a dial handle 1 and a transmission shaft 2, the transmission shaft 2 is snap-fit with the dial handle 1, and the transmission shaft 2 is fixed within the first positioning through-hole 162 through the first connecting structure 13 and allows the dial handle 1 to be located within the first counterbore 161. Preferably, the first counterbore 161 and the first positioning through-hole 162 have the same rotation center shaft, wherein the diameter of the first positioning through-hole 162 is smaller than the diameter of the first counterbore 161, so as to form the first step hole 16.

Referring again to FIG. 2, a straight prism shaft structure 102 and a neck 101 are provided on the dial handle 1, a straight prism blind hole 201 matched with the straight prism shaft structure 102 and a steel ball connecting mechanism 17 are provided on the transmission shaft 2, and the dial handle 1 and the transmission shaft 2 are snapped in such a way that the straight prism shaft structure 102 is matched with the straight prism blind hole 201 and the neck 101 is matched with the steel ball connecting mechanism 17.

Preferably, the straight prism shaft structure 102 provided on the dial handle 1 is provided as a straight hexagonal prism structure, ensuring that the dial handle 1 may transmit a torque through the straight prism shaft structure 102. The straight prism shaft structure may also be other non-cylindrical columnar structures, such as a straight triangular prism, a straight quadrangular prism, and a straight pentagonal prism. The corresponding straight prism blind hole 201 may be provided as other non-cylindrical blind holes, such as a straight triangular prism blind hole, a straight quadrangular prism blind hole, and a straight pentagonal blind hole. Thus, the torque of the dial handle 1 may transmit a torque directly in such a way that the straight prism shaft structure 102 is snap-fit with the straight prism blind hole 201. Thus, the dial handle 1 may drive the transmission shaft 2 to rotate.

Figure 3:
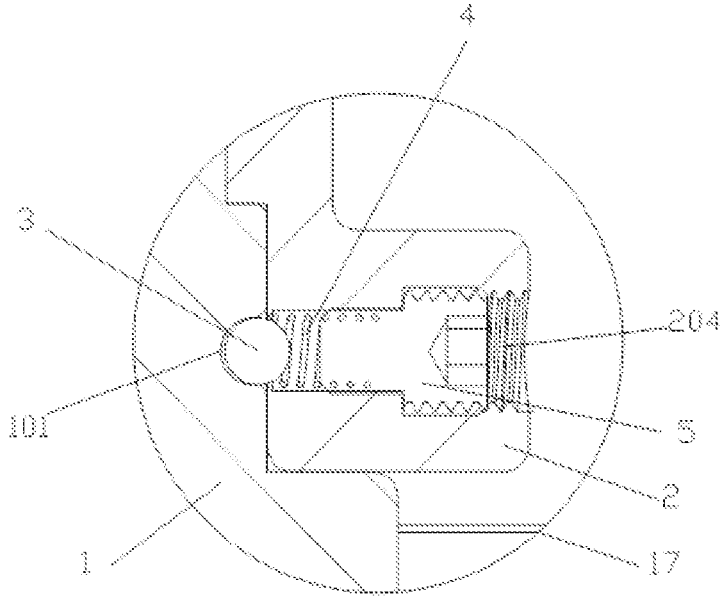
FIG. 3 is a partial enlarged view of a steel ball connecting mechanism according to the utility model.

Referring to FIG. 3, the steel ball connecting mechanism 17 comprises at least a steel ball 3, a spring 4, a bolt 5, and a limiting hole 204. The steel ball 3 is connected to one end of the limiting hole 204 near the inner wall of the straight prism blind hole 201 of the transmission shaft 2 and is snapped into the neck 101 when the dial handle 1 is snap-fit with the transmission shaft 2, so that the depth of the dial handle 1 inserted into the transmission shaft is effectively positioned, thereby ensuring an effective connection between the dial handle 1 and the transmission shaft. The bolt 5 is connected to the other end of the limiting hole 204, and the steel ball 3 and the bolt 5 are connected by the spring 4. When the dial handle 1 is pulled out or pried, the steel ball 3 is subjected to the force exerted by the neck 101 provided on the dial handle 1. This force is transferred to the spring 4 in the limiting hole 204 by the steel ball 3 so that the spring 4 of the limiting hole 204 is compressed to move the steel ball 3 to the inside of the limiting hole 204, resulting in failure of the positioning and snap-fitting of the steel ball connecting mechanism 17 and the detachment of the dial handle 1 from the transmission shaft 2. As a result, a prizer loses the origin of force of prying a door, further enhancing the prying-resistant function of a safe door. When the dial handle 1 is inserted, the steel ball 3 is pressed by the dial handle 1, and the spring 4 in the limiting hole 204 is compressed and moved into the limiting hole 204. When the dial handle 1 continues to be inserted until the neck 101 moves to the steel ball 3, the elastic potential energy stored by the spring 4 in the limiting hole 204 is released, the steel ball 3 is pushed out, and the positioning and snap-fitting of the steel ball connecting mechanism 17 with the dial handle 1 is achieved.

Preferably, one end of the limiting hole 204 connected to the steel ball 3 is provided with a spherical port matched with the sphere of the steel ball 3, and the other end thereof is provided with a threaded structure matched with the bolt 5. Preferably, one end of the limiting hole 204 connected to the steel ball 3 is provided with a spherical port matched with the sphere of the steel ball 3, which may ensure that the steel ball 3 will not slip out of the port and the steel ball 3 is also combined with the neck 101 to the utmost extent to achieve positioning and snap-fitting. The other end thereof is provided with a threaded structure matched with the bolt 5 so that the bolt 5 is threadedly connected with the limiting hole 204 and the bolt 5 is fixed. It may ensure that the spring 4 in the limiting hole 204 can store the corresponding elastic potential energy after being pressed, and realize that the spring 4 pushes the steel ball 3 back to the original position by releasing the elastic potential energy.

Preferably, the structure of the neck 101 and the structure of the steel ball 3 provided on the dial handle 1 are matched.

Referring again to FIG. 2, the transmission shaft 2 is further provided with a positioning shaft 202 and a first screw 203, wherein the transmission shaft 2 positions and connects the dial handle 1 within the first counterbore 161 in such a way that the positioning shaft 202 is snapped with the first positioning through-hole 162 and the first screw 203 is connected with the first connecting structure 18. As a result, the positioning between the transmission shaft and the door plate is more accurate.

Figure 4:
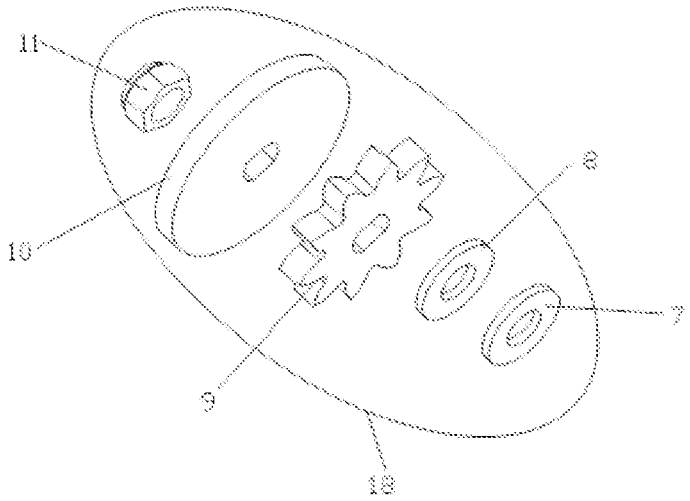
FIG. 4 is a partial enlarged view of a first connecting structure according to the utility model.

Referring again to FIG. 4, the first connecting structure 18 comprises a gear 9, a first nut 11, a first gasket 8, a second gasket 7 and a third gasket 10, and the first screw 203 is sequentially connected with the first gasket 7, the second gasket 8, the gear 9, the third gasket 10 and the first nut 11 in series after being assembled in the first step hole 16, and is connected with a transmission mechanism of the lock through the gear 9 in the first connecting structure 18.

Figure 5:
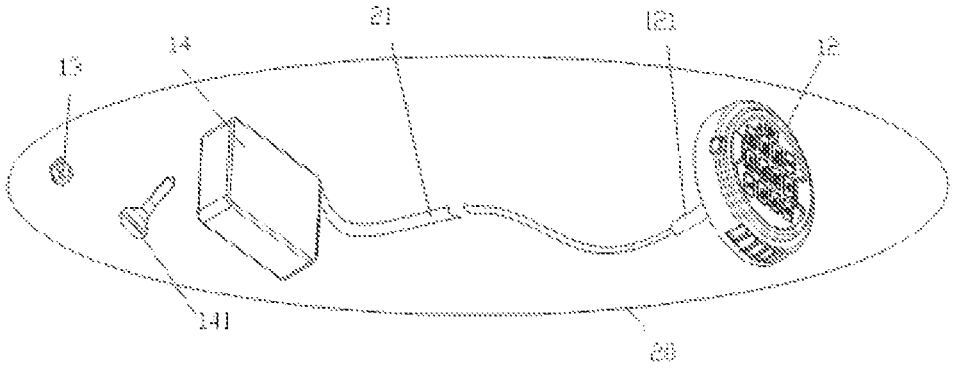
FIG. 5 is a schematic structural view of a lock according to the utility model.

Referring to FIG. 5, the second step hole 15 comprises a second counterbore 151 and a second positioning through-hole 152, the lock 20 comprises a lock disc 12 with a second screw 121, and the second screw 121 is fixed in the second positioning through-hole 152 and allows the lock dial 12 to be located within the second counterbore 151. The second screw 121 is fixed through a second nut 13 after being fixed in the second positioning through-hole 152. The second screw 121 is snap-fit with the second positioning through-hole 152 to position and connect the lock disc 12 and the door plate 6. The second screw 121 is connected through the thread of the second nut 13, so that the second step hole 15 of the lock disc 12 is fixedly connected.

Referring again to FIG. 5, the lock 20 further comprises an inner lock 14 and a data line 21, wherein the inner lock 14 is fixed inside the door plate 6 through a second connecting structure 141 and is connected with the lock dial 12 through the data line 21. Preferably, the second connecting structure 141 may be a screw or other structures that may be used to fix the inner lock, such as a latch and a buckle. By dividing the lock into two main parts, i.e., the lock disc 12 and the inner lock 14, the depth of the second step hole 15 on the door plate 6 may be effectively controlled on the one hand, and the inner lock 14 of the lock 20 may be installed inside the door plate 6 on the other hand, so as to prevent the inner lock 14 from being pried and further enhance the prying-resistant function of the safe door.

Preferably, the second screw 121 is provided with a through-hole in the middle so that one end of the data line 21 may pass through the through-hole and is connected with the lock disc 12, and the other end thereof is connected with the inner lock 14.

The foregoing descriptions are merely specific embodiments of the utility model, but the protection scope of the utility model is not limited thereto. Any changes or replacements conceivable by those skilled in the art within the technical scope disclosed by the utility model should fall within the protection scope of the utility model. Therefore, the protection scope of the utility model shall be subject to the protection scope of the claims.

What is claimed is:

1. A safe door with a recessed lock and door handle, comprising a door plate (6), a door handle (19) and a lock (20), wherein the door handle (19) is recessed and installed in a first step hole (16) of the door plate (6) through a first connecting structure (18), the lock (20) is recessed and installed in a second step hole (15) of the door plate (6), and the upper surfaces of the door handle (19) and the lock (20) are not higher than the upper surface of the door plate (6); and wherein the first step hole (16) comprises a first counterbore (161) and a first positioning through-hole (162), the door handle (19) comprises a dial handle (1) and a transmission shaft (2), the transmission shaft (2) is snap-fit with the dial handle (1), and the transmission shaft (2) is positioned and connected within the first positioning through-hole (162) through the first connecting structure (18) and allows the dial handle (1) to be located within the first counterbore (161).

2. The safe door with a recessed lock and door handle according to claim 1, wherein a straight prism shaft structure (102) and a neck (101) are provided on the dial handle (1), a straight prism blind hole (201) matched with the straight prism shaft structure (102) and a steel ball connecting mechanism (17) are provided on the transmission shaft (2), and the dial handle (1) and the transmission shaft (2) are snapped in such a way that the straight prism shaft structure (102) is matched with the straight prism blind hole (201) and the neck (101) is matched with the steel ball connecting mechanism (17).

3. The safe door with a recessed lock and door handle according to claim 2, wherein the steel ball connecting mechanism (17) comprises at least a steel ball (3), a spring (4), a bolt (5), and a limiting hole (204), wherein the steel ball (3) is connected to one end of the limiting hole (204) near the inner wall of the straight prism blind hole (201) of the transmission shaft (2), the bolt (5) is connected to the other end of the limiting hole (204), and the steel ball (3) and the bolt (5) are connected by the spring (4).

4. The safe door with a recessed lock and door handle according to claim 3, wherein one end of the limiting hole (204) connected to the steel ball (3) is provided with a spherical port matched with the sphere of the steel ball (3), and the other end thereof is provided with a threaded structure matched with the bolt (5).

5. The safe door with a recessed lock and door handle according to claim 4, wherein the structure of the neck (101) and the structure of the steel ball (3) provided on the dial handle (1) are matched.

6. The safe door with a recessed lock and door handle according to claim 5, wherein the transmission shaft (2) is further provided with a positioning shaft (202) and a first screw (203), wherein the transmission shaft (2) positions and connects the dial handle (1) within the first counterbore (161) in such a way that the positioning shaft (202) is snap-fit with the first positioning through-hole (162) and the first screw (203) is connected with the first connecting structure (18).

7. The safe door with a recessed lock and door handle according to claim 1, wherein the first connecting structure (18) comprises a gear (9), a first nut (11), a first gasket (8), a second gasket (7) and a third gasket (10), and the first screw (203) is sequentially connected with the first gasket (7), the second gasket (8), the gear (9), the third gasket (10) and the first nut (11) in series after being assembled in the first step hole (16), and is connected with a transmission mechanism of the lock through the gear (9) in the first connecting structure (18).

8. The safe door with a recessed lock and door handle according to claim 7, wherein the second step hole (15) comprises a second counterbore (151) and a second positioning through-hole (152), the lock (20) comprises a lock disc (12) with a second screw (121) and a second nut (13) matched with the second screw (121), and the second screw (121) is fixed in the second positioning through-hole (152) through the second nut (13) and allows the lock dial (12) to be located within the second counterbore (151).

9. The safe door with a recessed lock and door handle according to claim 8, wherein the lock (20) further comprises an inner lock (14) and a data line (21), wherein the inner lock (14) is fixed inside the door plate (6) through a second connecting structure (141) and is connected with the lock dial (12) through the data line (21).

* * * * *